US007850263B2

(12) United States Patent
Shinada et al.

(10) Patent No.: US 7,850,263 B2
(45) Date of Patent: Dec. 14, 2010

(54) LIQUID CONSUMPTION APPARATUS AND LIQUID CONSUMPTION AMOUNT CONTROL METHOD

(75) Inventors: Satoshi Shinada, Shiojiw (JP); Taku Ishizawa, Matsumoto (JP); Masayoshi Katayama, Matsumoto (JP); Noboru Asauchi, Nagano (JP); Hideki Okumura, Shiojiyi (JP)

(73) Assignee: Seiko Epson Corporation, Tokyo (JP)

( * ) Notice: Subject to any disclaimer, the term of this patent is extended or adjusted under 35 U.S.C. 154(b) by 332 days.

(21) Appl. No.: 11/755,548

(22) Filed: May 30, 2007

(65) Prior Publication Data

US 2008/0007580 A1 Jan. 10, 2008

(30) Foreign Application Priority Data

May 31, 2006 (JP) ..... 2006-150959

(51) Int. Cl.
*B41J 2/195* (2006.01)
*B41J 29/393* (2006.01)

(52) U.S. Cl. ..... 347/7; 347/19

(58) Field of Classification Search ..... 347/7
See application file for complete search history.

(56) References Cited

U.S. PATENT DOCUMENTS

2003/0025741 A1 2/2003 Maeda
2003/0071862 A1* 4/2003 Tsukada et al. ..... 347/7

FOREIGN PATENT DOCUMENTS

| | | | |
|---|---|---|---|
| EP | 1336498 | A1 | 8/2003 |
| EP | 1570998 | A1 | 9/2005 |
| EP | 1754609 | A2 | 2/2007 |
| JP | 08-034123 | | 2/1996 |
| JP | 09-169118 | | 6/1997 |
| JP | 2003-039694 | | 2/2003 |
| WO | 01/87626 | A1 | 11/2001 |

* cited by examiner

*Primary Examiner*—Matthew Luu
*Assistant Examiner*—Shelby Fidler
(74) *Attorney, Agent, or Firm*—Workman Nydegger

(57) ABSTRACT

The invention provides a liquid consumption apparatus including a liquid consumption unit, a counting unit that counts the amount of the liquid consumed by the liquid consumption unit as a liquid consumption amount, a reception unit that receives a detection signal indicating that the amount of the liquid contained in the liquid container is not more than a predetermined amount; a detection-time liquid amount memory unit that memorizes the liquid consumption amount at the time of reception of the detection signal as a detection-time liquid consumption amount, and a judgment unit that judges that the liquid container is empty when the amount of difference between the liquid consumption amount and the detection-time liquid consumption amount is not more than a specified amount.

15 Claims, 9 Drawing Sheets

LIQUID CONSUMPTION APPARATUS AND LIQUID CONSUMPTION AMOUNT CONTROL METHOD

BACKGROUND

1. Technical Field

The present invention relates to a liquid consumption apparatus that uses liquids and a liquid consumption amount control method that manages the amount of liquid consumption in the liquid consumption apparatus.

2. Related Art

There are known techniques for controlling the amount of liquid consumption in various kinds of liquid consumption apparatuses that consume liquids. An example of known liquid consumption apparatuses is a printing apparatus to which one or more ink cartridges are detachably attached so that the printing apparatus uses ink to perform a printing job processing. As an example of various techniques for managing the remaining amount of ink in such a printing apparatus, a technique for counting ink drops that are discharged from a print head is known. Another known art adopts a liquid level indication sensor for determining as to whether or not the amount of ink remaining in an ink cartridge is not more than a predetermined amount.

According to the technique that counts the number of ink drops, because it is necessary to take such factors as ink cartridge capacity error and ink drop weight variation into consideration, there has been a problem in that it is difficult to improve the utilization efficiency of ink contained in each ink cartridge. On the other hand, according to the technique that employs a liquid level indication sensor, there has been a problem in that it is impossible to control the amount of remaining ink or the amount of ink consumption until the liquid level indication sensor detects that the amount of ink remaining in an ink cartridge is not more than a predetermined amount. As an example of publication that proposes a solution for addressing the above problems, Japanese Patent No. 3,102,271 discloses a technique that adopts both of the ink-drop counting technique and the liquid level indication sensor technique, where the count value of the number of ink drops is corrected into a predetermined value upon detection of the ink amount not more than a predetermined amount by the liquid level indication sensor.

However, when the liquid level indication sensor detects that the amount of remaining ink is not more than a predetermined amount, the proposed technique, which corrects the count value of the number of ink drops into a predetermined value, could cause the second occurrence of the same count value, which could result in defective counting. That is, it is impossible to judge which count value, either the count value recognized before detection of ink amount not more than a predetermined one by the liquid level indication sensor or the count value recognized after detection thereof, is a correct value. As described above, the related art that employs both of the ink-drop counting technique and the liquid level indication sensor technique has not solved the problem of each art and posed another problem unique to such a combination approach.

SUMMARY

An advantage of some aspects of the invention is to enhance the level of convenience/user-friendliness in liquid consumption amount control and also to improve precision in such control.

In order to solve at least a part of the above-identified problems, the invention provides, as a first aspect thereof, a liquid consumption apparatus to which a liquid container for containing liquid is attachable. A liquid consumption apparatus according to the first aspect of the invention includes: a liquid consumption section that consumes the liquid contained in the liquid container; a counting section that counts the amount of the liquid consumed by the liquid consumption section as a liquid consumption amount; a liquid amount memory section that memorizes the liquid consumption amount counted by the counting section; a reception section that receives a detection signal indicating that the amount of the liquid contained in the liquid container is not more than a predetermined amount; a detection-time liquid amount memory section that memorizes the liquid consumption amount at the time of reception of the detection signal as a detection-time liquid consumption amount, that is, a liquid consumption amount at the time of detection; and a judgment section that judges that the liquid container is empty when the amount of difference between the liquid consumption amount memorized in the liquid amount memory section and the detection-time liquid consumption amount is not more than a specified amount.

According to the liquid consumption apparatus in the first aspect of the invention, it is possible to enhance the level of convenience/user-friendliness in liquid consumption amount control and also to improve precision in such control because it is judged that the liquid container is empty when the amount of difference between the liquid consumption amount memorized in the liquid amount memory section and the detection-time liquid consumption amount is not more than a specified amount.

In the liquid consumption apparatus according to the first aspect of the invention, it may be preferably configured that the counting section counts the amount of the liquid consumed by the liquid consumption section by counting unit liquid consumption amount, and increases the unit liquid consumption amount upon the reception of the detection signal by the reception section. Alternatively, it may be preferably configured therein that the counting section counts the amount of the liquid consumed by the liquid consumption section by counting unit liquid consumption amount, and decreases the unit liquid consumption amount upon the reception of the detection signal by the reception section.

With the above preferable configuration, it is possible to improve the utilization efficiency of the liquid contained in the ink container without making the liquid container empty.

In the liquid consumption apparatus according to the first aspect of the invention, it may be preferably configured that the judgment section increases or decreases the specified amount depending on the degree of consumption with respect to the liquid consumption amount up to the reception of the detection signal by the reception section.

With the above preferable configuration, it is possible to improve the utilization efficiency of the liquid contained in the ink container without making the liquid container empty.

In the liquid consumption apparatus according to the first aspect of the invention, it may be preferably configured that the liquid container is provided with a detector for detecting whether the amount of the liquid contained in the liquid container is not more than a predetermined amount or not, and that the liquid consumption apparatus further includes a detector driving section that drives the detector to obtain a detection result, wherein the reception section receives the detection signal from the detector, which is driven by the detector driving section.

With the above preferable configuration, it is possible to improve precision in the control of the liquid consumption amount on the liquid container that is provided with the detector.

As a preferred configuration, the liquid consumption apparatus according to the first aspect of the invention may be configured to further include a detector for detecting whether the amount of the liquid contained in the liquid container is not more than a predetermined amount or not, wherein the reception section receives the detection signal from the detector.

With the above preferable configuration, it is possible to improve precision in the control of the liquid consumption amount on the liquid container that is not provided with the detector.

In the liquid consumption apparatus according to the first aspect of the invention, it may be preferably configured that the detection-time liquid amount memory section memorizes the liquid consumption amount memorized in the liquid amount memory section at the time of reception of the detection signal as the detection-time liquid consumption amount. With such a preferable configuration, it is possible to acquire the detection-time liquid consumption amount in a speedy manner.

In the liquid consumption apparatus according to the first aspect of the invention, it may be preferably configured that the detection-time liquid amount memory section memorizes the liquid consumption amount counted by the counting section after reception of the detection signal as the detection-time liquid consumption amount. With such a preferable configuration, it is possible to make the detection-time liquid consumption amount larger than actual liquid consumption amount at the time of detection.

In the liquid consumption apparatus according to the first aspect of the invention, it may be preferably configured that the liquid container is provided with a memory device, and that the liquid consumption apparatus further includes a writing section that writes the liquid consumption amount memorized in the liquid amount memory section into the memory device provided in the liquid container at a predetermined timing, wherein the counting section reads the liquid consumption amount memorized in the memory device at least at the time of activation of the liquid consumption apparatus so as to count the liquid consumption amount by using the read-out liquid consumption amount. With such a preferable configuration, it is possible to perform the control of the liquid consumption amount with a high precision even when the liquid container is detached because the liquid consumption amount can be stored into the memory device of the liquid container.

As a preferred configuration, the liquid consumption apparatus according to the first aspect of the invention may be configured to further include a display section that displays information on the amount of the liquid based on the liquid consumption amount until the liquid consumption amount reaches a reference liquid consumption amount, based on the reference liquid consumption amount after the liquid consumption amount has reached the reference liquid consumption amount but until the detection signal is received, and based on the liquid consumption amount and the detection-time liquid consumption amount after the detection signal has been received.

With such a preferable configuration, it is possible to avoid any decrease in information on the displayed liquid amount when the information on the displayed liquid amount has an increase characteristic, whereas it is possible to avoid any increase in information on the displayed liquid amount when the information on the displayed liquid amount has a decrease characteristic. Consequently, it is possible to reduce increasing/decreasing variations in the information on the liquid amount for moth than one times.

In the liquid consumption apparatus according to the first aspect of the invention, it may be preferably configured that the liquid consumption apparatus is an ink jet printer, and the liquid container is an ink container that contains ink.

The invention provides, as a second aspect thereof, a liquid consumption amount control apparatus that controls liquid consumption amount in a liquid consumption apparatus to which a liquid container for containing liquid is attached for use. A liquid consumption amount control apparatus according to the second aspect of the invention includes: a liquid consumption amount information reception section that receives liquid consumption amount information on the amount of the liquid consumed by the liquid consumption apparatus from the liquid consumption apparatus; a liquid amount memory section that memorizes the received liquid consumption amount information one after another; a detection signal reception section that receives a detection signal indicating that the amount of the liquid contained in the liquid container is not more than a predetermined amount; a detection-time liquid amount memory section that memorizes the liquid consumption amount at the time of reception of the detection signal as a detection-time liquid consumption amount, that is, a liquid consumption amount at the time of detection; and a judgment section that judges that the liquid container is empty when the amount of difference between the liquid consumption amount memorized in the liquid amount memory section and the detection-time liquid consumption amount is not more than a specified amount.

According to the liquid consumption amount control apparatus in the second aspect of the invention, it is possible to enhance the level of convenience/user-friendliness in liquid consumption amount control and also to improve precision in such control because it is judged that the liquid container is empty when the amount of difference between the liquid consumption amount memorized in the liquid amount memory section and the detection-time liquid consumption amount is not more than a specified amount.

As a preferred configuration, the liquid consumption amount control apparatus according to the second aspect of the invention may be configured to be connected to a display apparatus, and to further include a display control section that controls the display apparatus to display information on the amount of the liquid based on the liquid consumption amount until the liquid consumption amount reaches a reference liquid consumption amount, based on the reference liquid consumption amount after the liquid consumption amount has reached the reference liquid consumption amount but until the detection signal is received, and based on the liquid consumption amount and the detection-time liquid consumption amount after the detection signal has been received.

With such a preferable configuration, it is possible to avoid any decrease in information on the displayed liquid amount when the information on the displayed liquid amount has an increase characteristic, whereas it is possible to avoid any increase in information on the displayed liquid amount when the information on the displayed liquid amount has a decrease characteristic. Consequently, it is possible to reduce increasing/decreasing variations in the information on the liquid amount for moth than one times.

The invention provides, as a third aspect thereof, a liquid consumption amount control method that controls liquid consumption amount in a liquid consumption apparatus to which a liquid container is attached for use. A liquid consumption amount control method according to the third aspect of the invention includes: counting the amount of the liquid consumed by a liquid consumption section that consumes the liquid contained in the liquid container as a liquid consumption amount; memorizing the liquid consumption amount counted by a counting section into a memory apparatus one after another; receiving a detection signal which indicates that the amount of the liquid contained in the liquid container is not more than a predetermined amount; memorizing the counted liquid consumption amount as a detection-time liquid consumption amount, that is, a liquid consumption amount at the time of detection, into the memory apparatus; and judging that the liquid container is empty when the amount of difference between the memorized liquid consumption amount and the detection-time liquid consumption amount is not more than a specified amount.

According to the liquid consumption amount control method in the third aspect of the invention, it is possible to obtain the same operation effects as those obtained by the liquid consumption apparatus according to the first aspect of the invention and the liquid consumption amount control apparatus according to the second aspect of the invention. In addition, the liquid consumption amount control method according to the third aspect of the invention may be implemented in a variety of modes and embodiments, as is the case with the liquid consumption apparatus according to the first aspect of the invention and the liquid consumption amount control apparatus according to the second aspect of the invention.

The liquid consumption amount control method according to the third aspect of the invention may also be implemented as a program that controls the liquid consumption amount in the liquid consumption apparatus, and/or a computer-readable storage medium in which such a program is stored.

BRIEF DESCRIPTION OF THE DRAWINGS

The invention will be described with reference to the accompanying drawings, wherein like numbers reference like elements.

DESCRIPTION OF EXEMPLARY EMBODIMENTS

With reference to accompanying drawings, a liquid consumption apparatus and a liquid consumption control method according to the invention are described below while explaining exemplary embodiments of the invention.

First Exemplary Embodiment

Configuration of Printing Apparatus and Cartridges

Figure 1:
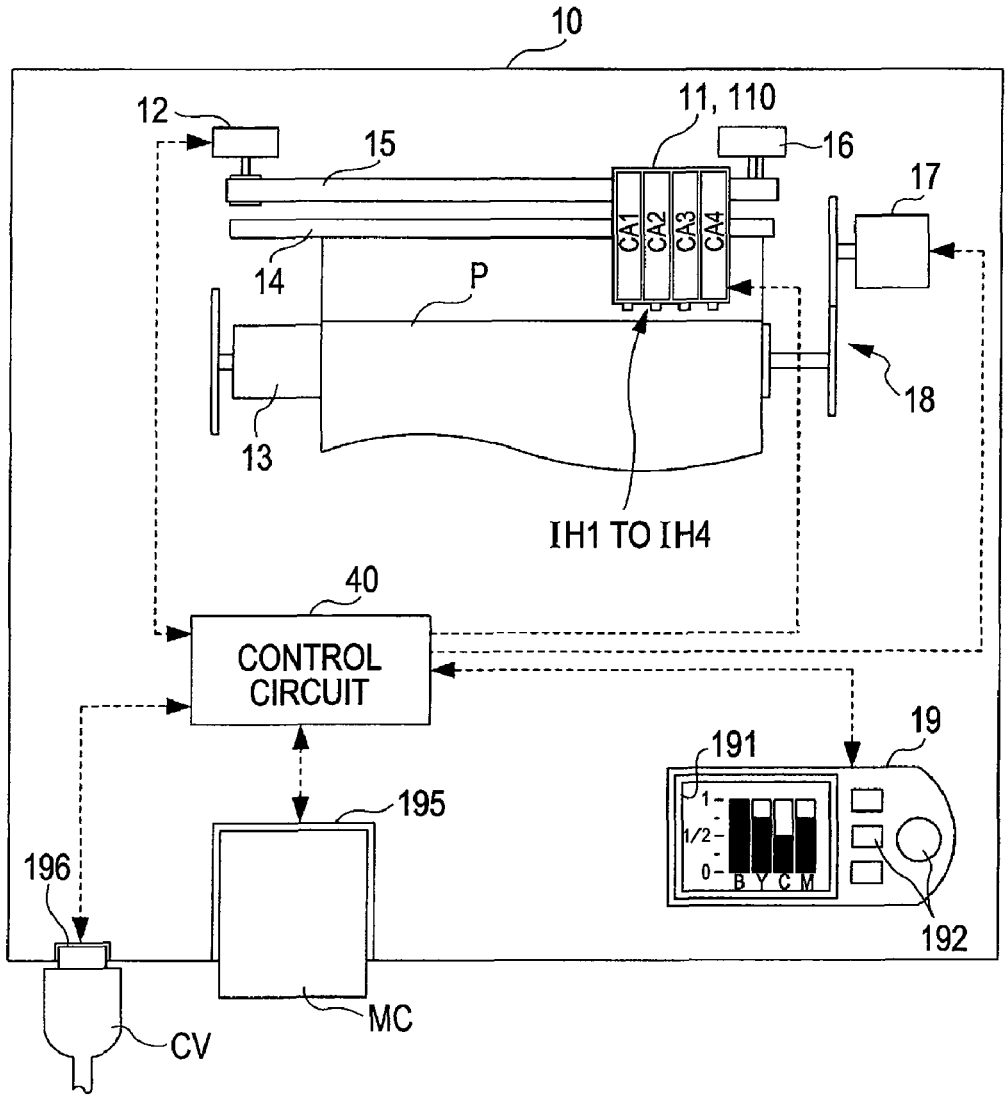
FIG. 1 is a schematic diagram that illustrates an example of the configuration of a printing apparatus according to an embodiment of the invention.

With reference to FIG. 1, the outline configuration of a printing apparatus according to the first exemplary embodiment of the invention is explained. FIG. 1 is a schematic diagram that illustrates an example of the configuration of a printing apparatus 10 according to the present embodiment of the invention.

In this embodiment, the printing apparatus 10 is taken as an example of a liquid consumption apparatus for explanation. The printing apparatus 10 is provided with a main scan feed mechanism, a sub scan feed mechanism, a print head driving mechanism, and a control circuit 40 that controls the driving of each of these mechanisms and implements various program functions for controlling the amount of consumption of ink as a liquid.

The main scan feed mechanism has a carriage motor 12 that drives a carriage 11, a sliding axis 14 that is provided in parallel with the axis of a platen 13 and supports the carriage 11 in a sliding manner, a pulley 16 that stretches a driving belt 15 without ends between the carriage motor 12 and the pulley 16 itself, and a position sensor (not shown in the figure) that detects the home position of the carriage 11. The main scan feed mechanism reciprocates the carriage 11 by means of the carriage motor 12 in the axial direction (main scan direction) of the platen 13.

The carriage 11 has a holder 110, print heads IH1-IH4, and a carriage circuit 1070, which is described later. The holder 110 is provided on the upper surface of the print heads IH1-IH4 in such a manner that a plurality of ink cartridges CA1-CA4 is detachably attached thereto. In an example illustrated in FIG. 1, four ink cartridges CA1-CA4 are detachably mounted to the holder 110, where, for example, the ink cartridges CA1-CA4 as a whole contain 4-color ink constituted by black, yellow, magenta, and cyan in such a manner that each color is assigned to one cartridge thereof. The print heads IH1-IH4 are communicated with the corresponding ink cartridges CA1-CA4 respectively by means of ink supply needles, which are not shown in the figure, so that ink contained in the ink cartridges CA1-CA4 are supplied to the corresponding print heads IH1-IH4 through the ink supply needles respectively.

The sub scan feed mechanism has a paper feed motor 17 and a gear train 18. The sub scan feed mechanism transports a printing paper P in the sub scan direction by communicating the rotational force of the paper feed motor 17 to the platen 13 via the gear train 18.

The head driving mechanism drives the print heads IH1-IH4 mounted on the carriage 11 to generate a desired dot pattern on the printing paper while controlling the amount of ink discharge and timing thereof. As an example of such an ink driving mechanism, a driving mechanism that utilizes the deformation of a piezoelectric element, which causes distortion when a voltage is applied thereto, may be used. As another example, such an ink driving mechanism may be constituted by use of air bubbles that are formed in ink by means of an electric heater that generates heat when a voltage is applied thereto.

The control circuit 40 is connected to the carriage motor 12, the paper feed motor 17, the carriage circuit 1070, and an operation panel 19 via signal lines. The control circuit 40 is further connected to a memory card slot 195 and an input and output terminal 196 via signal lines. The control circuit 40 may be connected to a computer or a digital still camera via the input and output terminal 196. In response to instructions given from the computer or through the operation panel 190, or under directions given by various programs stored in the control circuit 40 itself, the control circuit 40 drives the carriage motor 12, the paper feed motor 17, and the print heads IH1-IH4.

The operation panel has a display panel 191 and operation keys 192. The display panel 191 is a color display panel that displays various kinds of information including image-related information or ink-amount-related information in a dot matrix pattern display of a predetermined resolution. The amount of ink remaining in each of the ink cartridges CA1-CA4 is displayed on the display panel 191 in a bar graph format. In addition, user interface (soft key) for implementing various print-related functions of the printing apparatus 10 is displayed on the display panel 191. The operation keys 192 are used for inputting, into the control circuit 40, the selection of a desired image data, or the selection and/or execution of other various functions. As an alternative configuration, if the display panel 191 serves a double function also as an input panel, various inputs may be made through the display panel 191.

Configuration of Ink Cartridge

Figure 2:
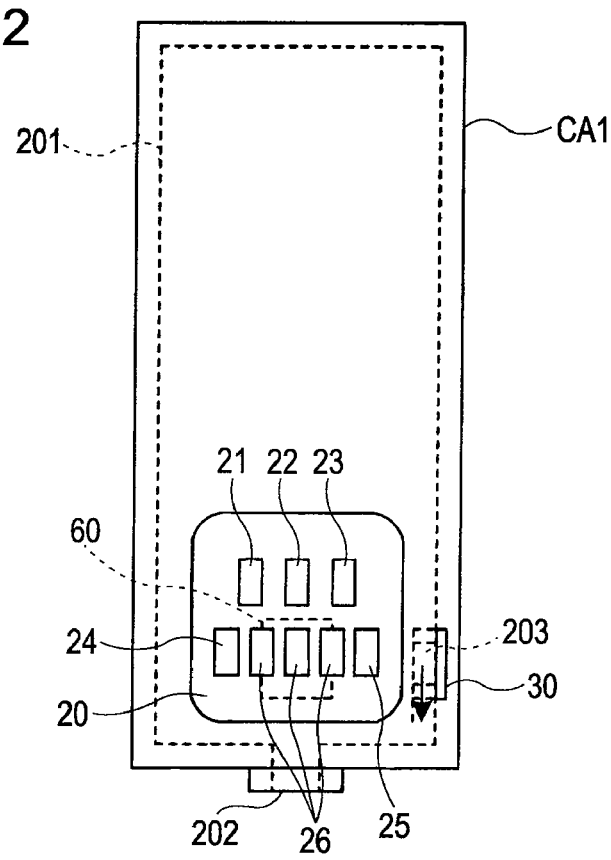
FIG. 2 is a schematic diagram that illustrates the front view of an ink cartridge according to an embodiment of the invention.
Figure 3:
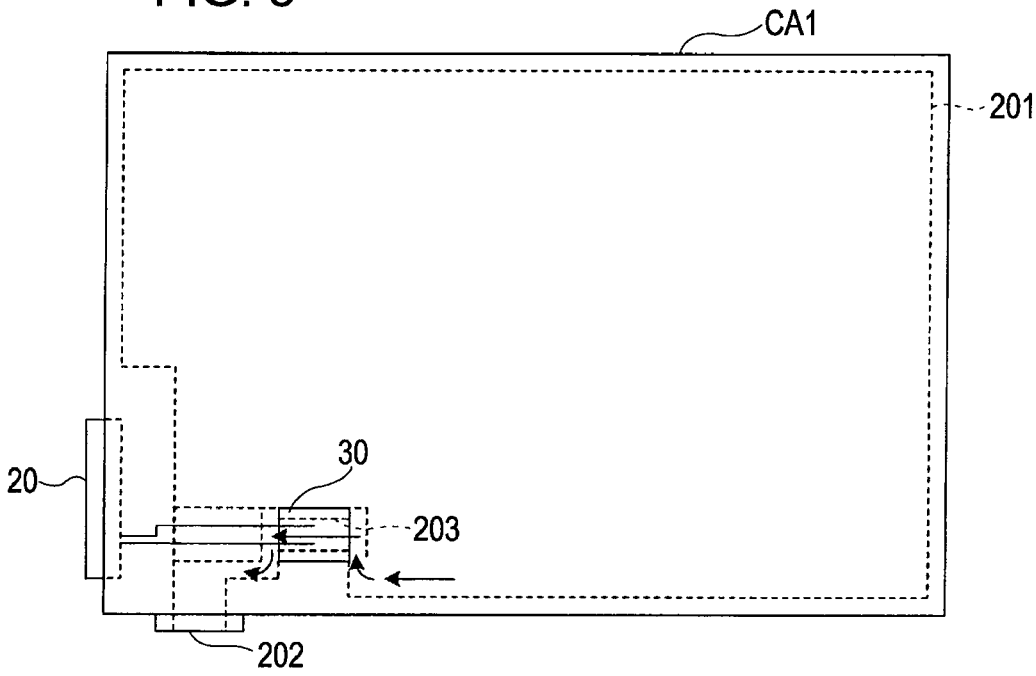
FIG. 3 is a schematic diagram that illustrates the side view of an ink cartridge according to an embodiment of the invention.

With reference to FIGS. 2 and 3, an exemplary configuration of an ink cartridge according to the present embodiment of the invention is explained. FIG. 2 is a schematic diagram that illustrates the front view of an ink cartridge according to this embodiment of the invention. FIG. 3 is a schematic diagram that illustrates the side view of the ink cartridge according to this embodiment of the invention.

In the following description, the ink cartridge CA1 is taken as an example for explanation. The ink cartridge CA1 is provided with an ink-containing portion 201 for containing ink, an ink-supplying portion 202 for supplying the ink to the ink supply needle, a substrate 20, and an ink end sensor 30.

As illustrated in FIG. 3, the ink-containing portion 201 and the ink-supplying portion 202 are in communication with each other through a communication path 203. The ink end sensor 30 is provided in the communication path 203. The ink end sensor 30 may be provided in such a manner that it contacts ink directly; or alternatively, it may be provided in indirect contact with ink such that a member for improving detection characteristics, for example, is interposed therebetween. As an example of the ink end sensor 30, a piezoelectric element, which distorts itself when a voltage is applied, may be used. The ink end sensor 30 is electrically connected to the terminal of the substrate 20.

A plurality of terminals 21-26 is provided on the substrate 20. As described later, the terminals 21-26 are electrically connected to the control circuit 40 through direct contact with the corresponding terminals of the carriage circuit 1070 of the printing apparatus 10. The plurality of terminals include, for example, a first cartridge-out detection terminal 21, a reference potential terminal 22, a second cartridge-out detection terminal 23, a first ink end sensor driving terminal 24, a second ink end sensor driving terminal 25, and a data terminal 26.

Figure 4:
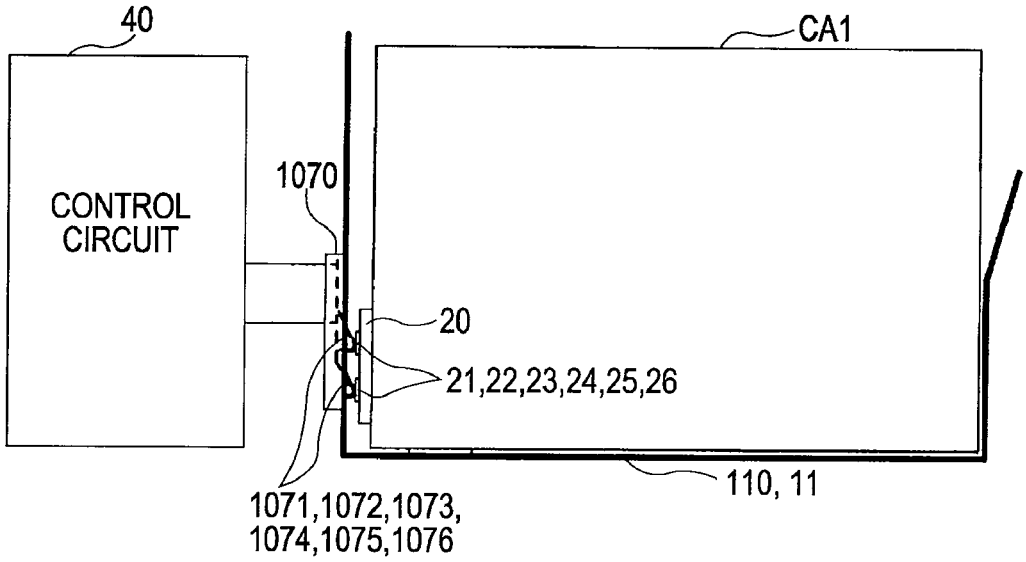
FIG. 4 is an explanatory diagram that schematically illustrates a state in which an ink cartridge according to an embodiment of the invention is attached to the carriage.
Figure 5:
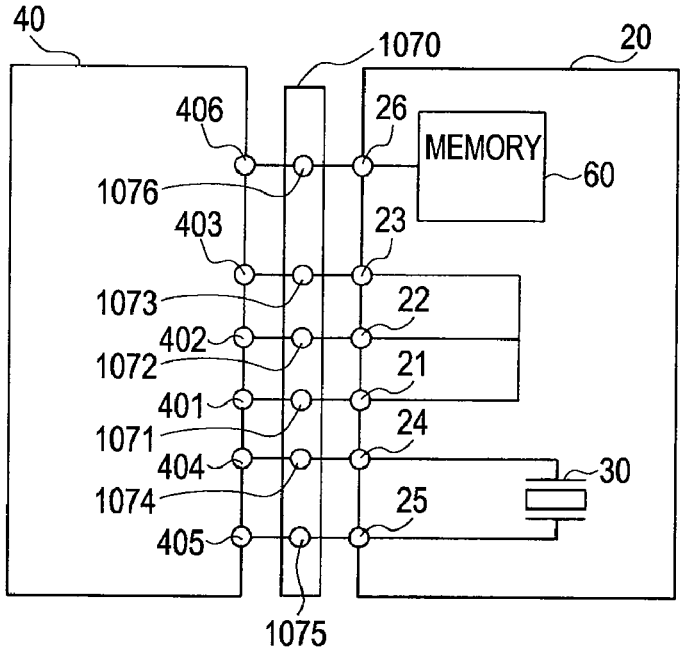
FIG. 5 is an explanatory diagram that illustrates an example of the circuit configuration of terminals on a substrate according to an embodiment of the invention.

With reference to FIGS. 4 and 5, an explanation is given below on the terminals 21-26 provided on the substrate 20. In addition, it is further explained here as to how the terminals 21-26 of the substrate 20 are connected to the carriage circuit 1070. FIG. 4 is an explanatory diagram that schematically illustrates a state in which the ink cartridge according to the present embodiment of the invention is attached to the carriage. FIG. 5 is an explanatory diagram that illustrates an example of the circuit configuration of the terminals on the substrate according to this embodiment of the invention.

The carriage circuit 1070 is provided with contact pins 1071-1076, each of which contacts the corresponding one of the terminals 21-26 of the substrate 20. The contact pins 1071-1076 are electrically connected to the terminals 401-406 of the control circuit 40, respectively. The contact pins 1071-1076 include, for example, a first cartridge-out detection pin 1071, a reference potential pin 1072, a second cartridge-out detection pin 1073, a first ink end sensor driving pin 1074, a second ink end sensor driving pin 1075, and a data pin 1076. The terminals 401-406 of the control circuit 40 include, for example, a first cartridge-out detection terminal 401, a reference potential terminal 402, a second cartridge-out detection terminal 403, a first ink end sensor driving terminal 404, a second ink end sensor driving terminal 405, and a data terminal 406.

When the ink cartridge CA1 is not attached to the holder 110, the tips of the contact pins 1071-1076 are positioned farther away from the carriage circuit 1070 than the positions of contact with the terminals 21-26 of the substrate 20 of the ink cartridge CA1. Therefore, upon attachment of the ink cartridge CA1 to the holder 110 of the carriage 11, the contact pins 1071-1076 of the carriage circuit 1070 are urged toward the corresponding terminals 21-26 of the substrate 20 so that the terminals 21-26 are electrically connected to the contact pins 1071-1076, respectively.

On the substrate 20, the first cartridge-out detection terminal 21 and the second cartridge-out detection terminal 23 are directly connected to the reference potential terminal 22. The first ink end sensor driving terminal 24 and the second ink end sensor driving terminal 25 are connected to the ink end sensor 30. The data terminal 26 is connected to a memory 60.

A driving voltage is inputted to either one of the first ink end sensor driving terminal 404 and the second ink end sensor driving terminal 405, where the driving voltage drives the ink end sensor 30 when determining as to whether or not the amount of ink contained in the ink-containing portion 201 is less than or equal to a predetermined value. As described later, the driving voltage is set at a level that is significantly higher than a detection voltage.

Configuration of Control Circuit

Figure 6:
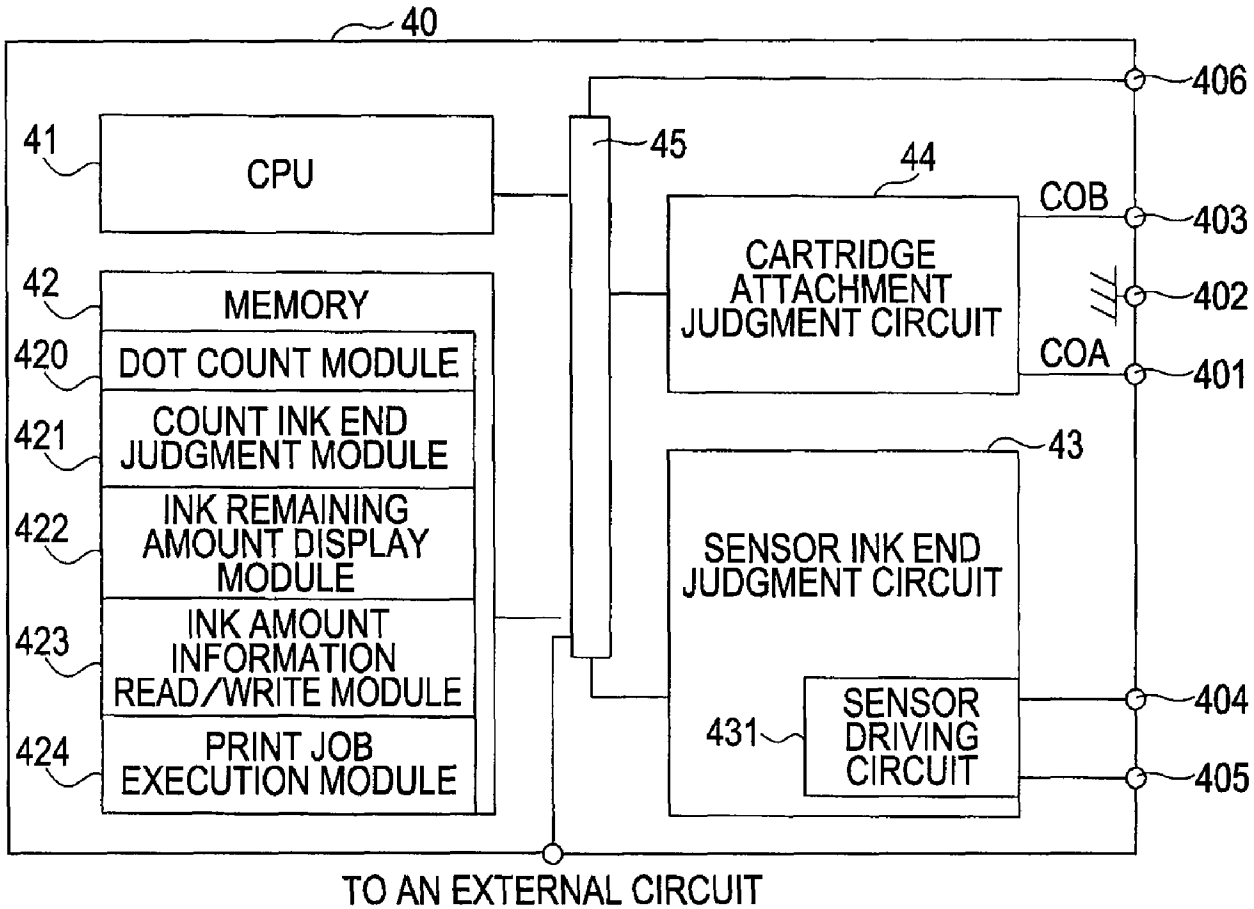
FIG. 6 is an explanatory diagram that illustrates, as functional blocks, an example of the inner configuration of a control circuit according to an embodiment of the invention.

With reference to FIG. 6, an explanation is given below on the functional inner configuration of the control circuit 40. FIG. 6 is an explanatory diagram that illustrates, as functional blocks, an example of the inner configuration of the control circuit 40 according to the present embodiment of the invention.

The control circuit 40 is provided with a central processing unit (CPU) 41, a memory 42, a sensor ink end judgment circuit 43, a cartridge attachment judgment circuit 44, and an input-output interface 45. As has already been described, the control circuit 40 has the terminals 401-406 that are connected to the corresponding terminals of the carriage circuit 1070. In this embodiment, a single set of the terminals 401-406, the sensor ink end judgment circuit 43, and the cartridge attachment judgment circuit 44 corresponding to only one ink cartridge CA is discussed for a simpler explanation. However, it should be noted that, when a plurality of ink cartridges CA is attached, the plural sets of the terminals 401-406, the sensor ink end judgment circuit 43, and the cartridge attachment judgment circuit 44 are provided such that each set corresponds to one of the plurality of ink cartridges CA.

The CPU 41, the memory 42, the sensor ink end judgment circuit 43, and the cartridge attachment judgment circuit 44 are connected one another to allow intercommunication therebetween via the input-output interface 45. The input-output interface 45 is further connected to an external circuit such as the carriage motor 12, the operation panel 19, and so forth.

The control circuit 40 actualizes various functional blocks by directing the CPU 41 to run various programs stored in the memory 42.

As various kinds of programs that are necessary for performing ink amount determination processing, the memory 42 stores a dot count module 420, a count ink end judgment module 421, an ink remaining amount display module 422, an ink amount information read/write module 423, and an print job execution module 424. In this embodiment, it should be noted that the memory 42 represents a generic storage unit that includes both a nonvolatile memory unit in which the above various programs are stored and a volatile memory unit for running of the various programs.

The dot count module 420 is a program for measuring the amount of ink consumed during ink consumption processing such as printing, flushing, and so on. The counted dot count value DC is written into the volatile memory unit section of the memory 42.

The count ink end judgment module 421 is a program that judges whether or not the dot count value DC counted by the dot count module 420 is less than or equal to an ink end dot count value DCref on count.

The ink remaining amount display module 422 generates ink-remaining-amount data that indicates the remaining amount of ink to be displayed on the display panel 191, and then displays the generated data on the display panel 191.

The ink amount information read/write module 423 is a program that writes the dot count value DC counted by the dot count module 420 into memory devices of the ink cartridges CA1-CA4 at a predetermined timing, or reads the dot count value DC out of the memory devices of the ink cartridges CA1-CA4.

The print job execution module 424 is a program that generates a dot pattern on the printing paper P by using the generated data for printing so as to generate an image represented by the printing data on the printing paper P.

The sensor ink end judgment circuit 43 is a circuit that judges whether or not the amount of ink contained in the ink cartridges CA1-CA4 is less than or equal to a predetermined amount. In this embodiment, because it is assumed that the ink end sensor 30 for detecting whether the amount of ink contained in the ink cartridges CA1-CA4 is not more than a predetermined amount or not is provided in each of the ink cartridges CA1-CA4, the sensor ink end judgment circuit 43 is provided with a sensor driving circuit 431 for driving the ink end sensor 30. When a plurality of ink cartridges CA is attached, the same number of the sensor driving circuits 431 as that of the ink cartridges are provided.

The sensor driving circuit 431 is connected to the first ink end sensor driving terminal 404 and the second ink end sensor driving terminal 405. Upon reception of instructions from the sensor ink end judgment circuit 43, the sensor driving circuit 431 applies a driving voltage having a predetermined waveform pattern to either one of the first ink end sensor driving terminal 404 and the second ink end sensor driving terminal 405. The driving voltage is set at a level higher than a detection voltage used for detecting the attachment of the ink cartridges CA1-CA4, for example, at approximately 40V. In this embodiment, a piezoelectric element is used as the ink end sensor 30. The application of the driving voltage is performed, for example, after completion of a printing job, and/or after completion of flushing (ink discharge processing for cleaning an ink head).

The sensor driving circuit 431 applies a driving voltage to the ink end sensor 30 via the first ink end sensor driving terminal 404 or the second ink end sensor driving terminal 405, the first ink end sensor driving pin 1074 or the second ink end sensor driving pin 1075, and the first ink end sensor driving terminal 24 or the second ink end sensor driving terminal 25. Upon application of a voltage, the ink end sensor 30 distorts itself due to inverse piezoelectric effect.

After supplying the driving voltage to the ink end sensor 30, the sensor driving circuit 431 electrically disconnects the driving voltage source from the line on which the driving voltage was supplied, for example, the line made up of the first ink end sensor driving terminal 404, the first ink end sensor driving pin 1074, and the first ink end sensor driving terminal 24. As a result of disconnection, electric charge accumulated in the ink end sensor 30 is discharged so that the ink end sensor 30 vibrates. A detection-result voltage (counter electromotive voltage) generated by the vibration of the ink end sensor 30 appears on the line through which the driving voltage is supplied, where the detection-result voltage has the vibration frequency of the ink end sensor 30 according to the amount of ink contained inside the ink-containing portion 201.

The detection-result voltage inputted into the sensor driving circuit 431 is forwarded to the sensor ink end judgment circuit 43. The sensor ink end judgment circuit 43 detects the remaining amount of ink by measuring the vibration frequency of the detection-result voltage. The vibration frequency of the detection-result voltage represents the natural vibration frequency of the peripheral structure (such as case, ink, etc.) around the ink end sensor 30 that vibrates as the ink end sensor 30 vibrates. The vibration frequency of the detection-result voltage changes depending on how much ink remains in the ink-containing portion 201. Therefore, it is possible to judge whether a sufficient amount of ink remains in the ink-containing portion 201 or not by driving the ink end sensor 30 by means of a waveform pattern that has the vibration frequency equivalent to the natural vibration frequency obtained when a sufficient amount of ink remains in the ink-containing portion 201 or by means of another waveform pattern that conforms to the natural vibration frequency obtained when there is less than a predetermined amount of ink remaining in the ink-containing portion 201, and then by judging whether the vibration frequency used for detection is successfully measured or not.

It should be noted that the sensor ink end according to this embodiment of the invention means a case of a predetermined amount where the ink amount is not 0. It should be further noted that the ink end sensor 30 does not detect the specific amount of ink remaining in the ink-containing portion 201 but detects whether the amount of ink remaining in the ink-containing portion 201 is not more than a predetermined amount or not.

The cartridge attachment judgment circuit 44 is a circuit that judges whether the ink cartridge CA is attached to the holder 110 of the printing apparatus 10 or not. The cartridge attachment judgment circuit 44 is connected to the first cartridge-out detection terminal 401 and the second cartridge-out detection terminal 403 via two signal lines COA and COB, respectively. A detection power voltage, for example, a voltage of approximately 3V, is applied to the first cartridge-out detection terminal 401 and the second cartridge-out detection terminal 403. In addition to these first and second cartridge-out detection terminals, the control circuit 40 further has the reference potential terminal 402 as another terminal used for determining whether the cartridge CA is attached or not. When a plurality of ink cartridges CA is attached, the same number of the cartridge attachment judgment circuit 44 as that of the ink cartridges are provided.

When the ink cartridge CA1 is properly attached to the holder 110 of the carriage 11, the potential of the first cartridge-out detection terminal 401 becomes equal to the potential of the reference potential terminal 402, that is, the reference potential. On the other hand, when the ink cartridge CA1 is improperly attached or not attached at all to the holder 110 of the carriage 11, the potential of the first cartridge-out detection terminal 401 becomes equal to the potential of the detection voltage. Herein, the reference potential may be a ground potential (0V), or may be a predetermined potential that is significantly lower than the detection voltage.

In this embodiment, in order to judge the presence/absence of the ink cartridge CA1 more accurately, two cartridge-out detection terminals are provided. When the ink cartridge CA1 is properly attached to the holder 110, the potential of the second cartridge-out detection terminal 403 becomes equal to the potential of the reference potential terminal 402, that is, the reference potential, whereas, when the ink cartridge CA1 is improperly attached or not attached at all to the holder 110, the potential of the second cartridge-out detection terminal 403 becomes equal to the potential of the detection voltage.

As an alternative configuration, the cartridge attachment judgment circuit 44 may extract the detection signal as a logical high signal or a logical low signal by means of a comparator. For example, if it is assumed that a judgment reference voltage Vref of 2V is inputted into the negative input pin of a comparator 412 whereas the potential of the first cartridge-out detection terminal 401 is inputted into the positive input pin of the comparator 412, the comparator 412 outputs a high signal (VCOA=1) when the potential inputted into the positive input pin is higher than the potential inputted into the negative input pin, while the comparator 412 outputs a low signal (VCOA=0) when the potential inputted into the positive input pin is lower than the potential inputted into the negative input pin.

Therefore, when the ink cartridge CA1 is properly attached to the carriage 11, the potential of the first cartridge-out detection terminal 401 becomes equal to the reference voltage (<Vref); and therefore, the comparator 412 outputs a low signal (VCOA=0). On the other hand, when the ink cartridge CA1 is improperly attached or not attached at all to the carriage 11, the potential of the first cartridge-out detection terminal 401 becomes equal to the detection voltage (>Vref); and therefore, the comparator 412 outputs a high signal (VCOA=1).

The cartridge attachment judgment circuit 44 judges that the ink cartridge CA1 is improperly attached or not attached at all to the carriage 11 if VCOA (VCOB) is a high signal (Hi), whereas it judges that the ink cartridge CA1 is properly attached to the carriage 11 if VCOA (VCOB) is a low signal (Lo).

The input-output interface 45 is connected to the data terminal 406 that is used for execution of write/read into/from the memory devices of the ink cartridges CA1-CA4.

Figure 7:
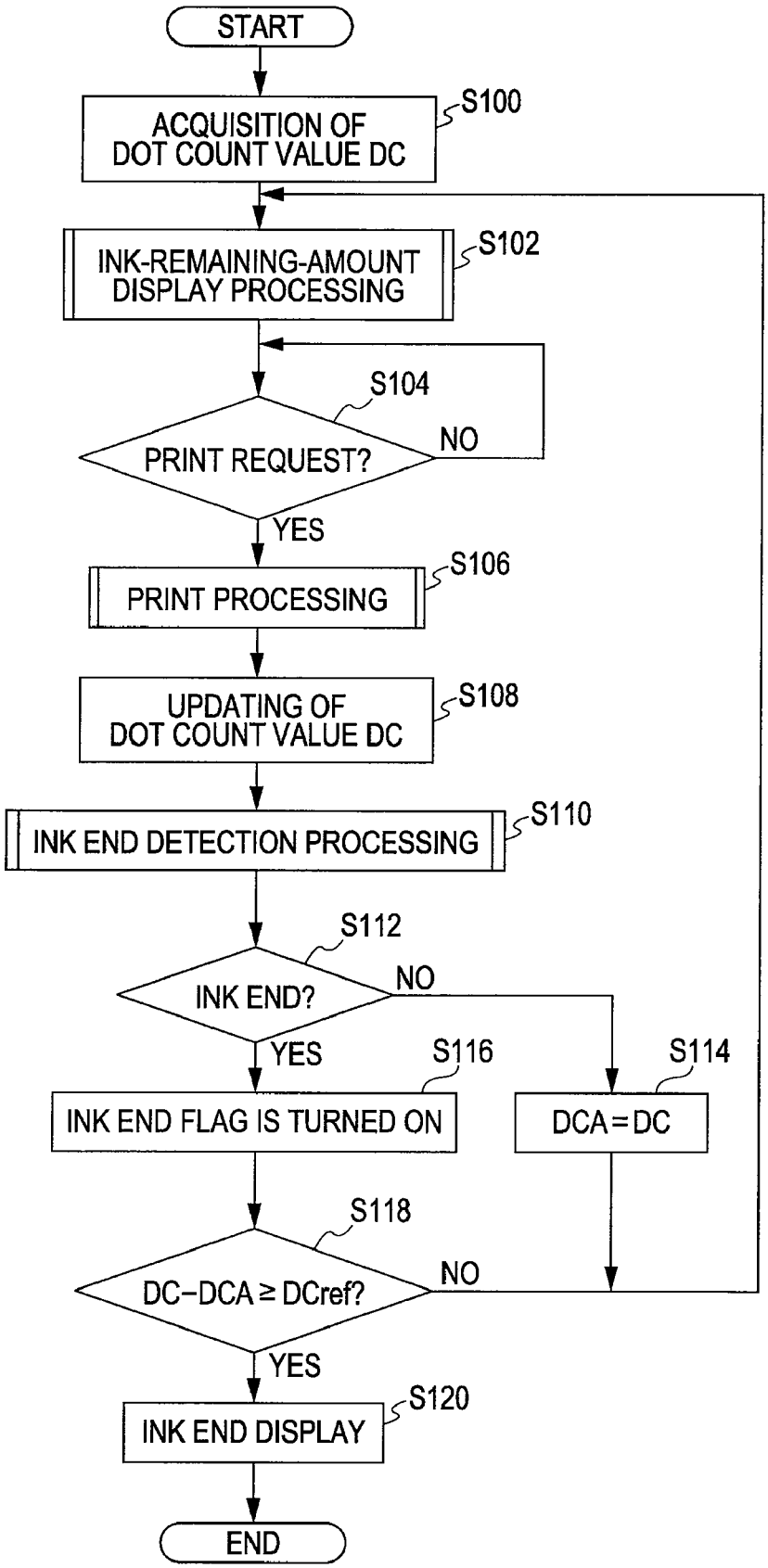
FIG. 7 is a flowchart that shows a processing routine that is performed during ink amount control processing executed by a printing apparatus according to an embodiment of the invention.
Figure 8:
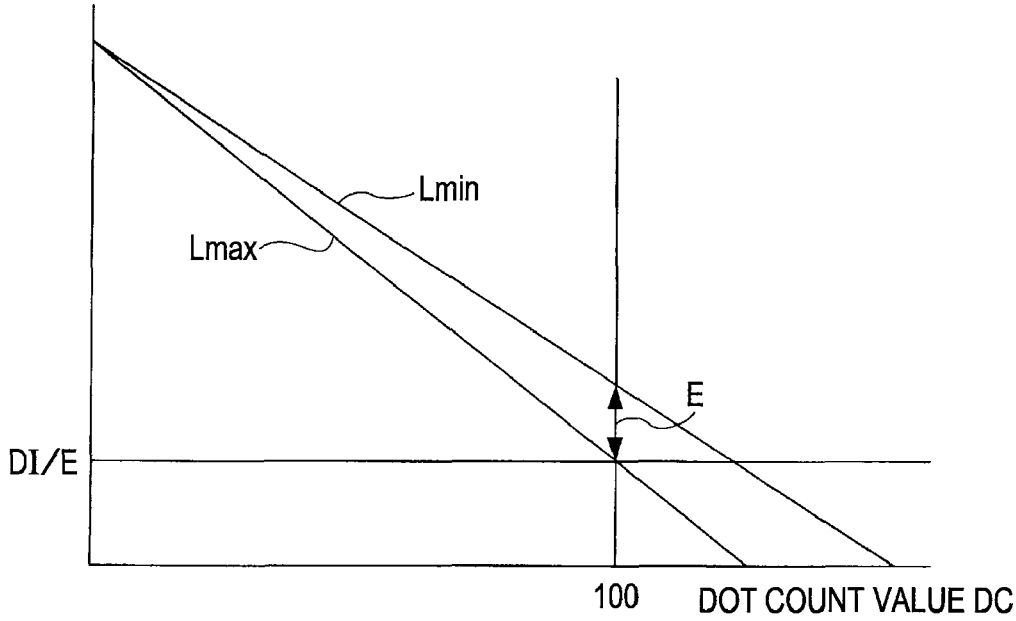
FIG. 8 is an explanatory diagram that illustrates the relationship between dot count values and the amount of ink.
Figure 9:
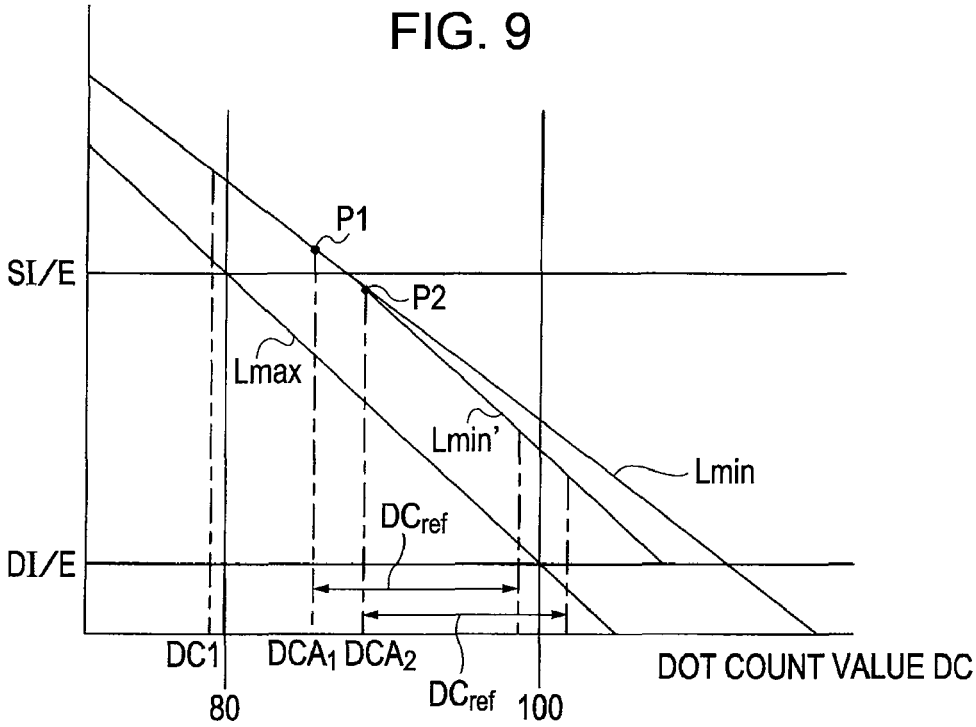
FIG. 9 is an explanatory diagram that illustrates the relationship between dot count values and the amount of ink in ink amount control processing according to an embodiment of the invention.
Figure 10:
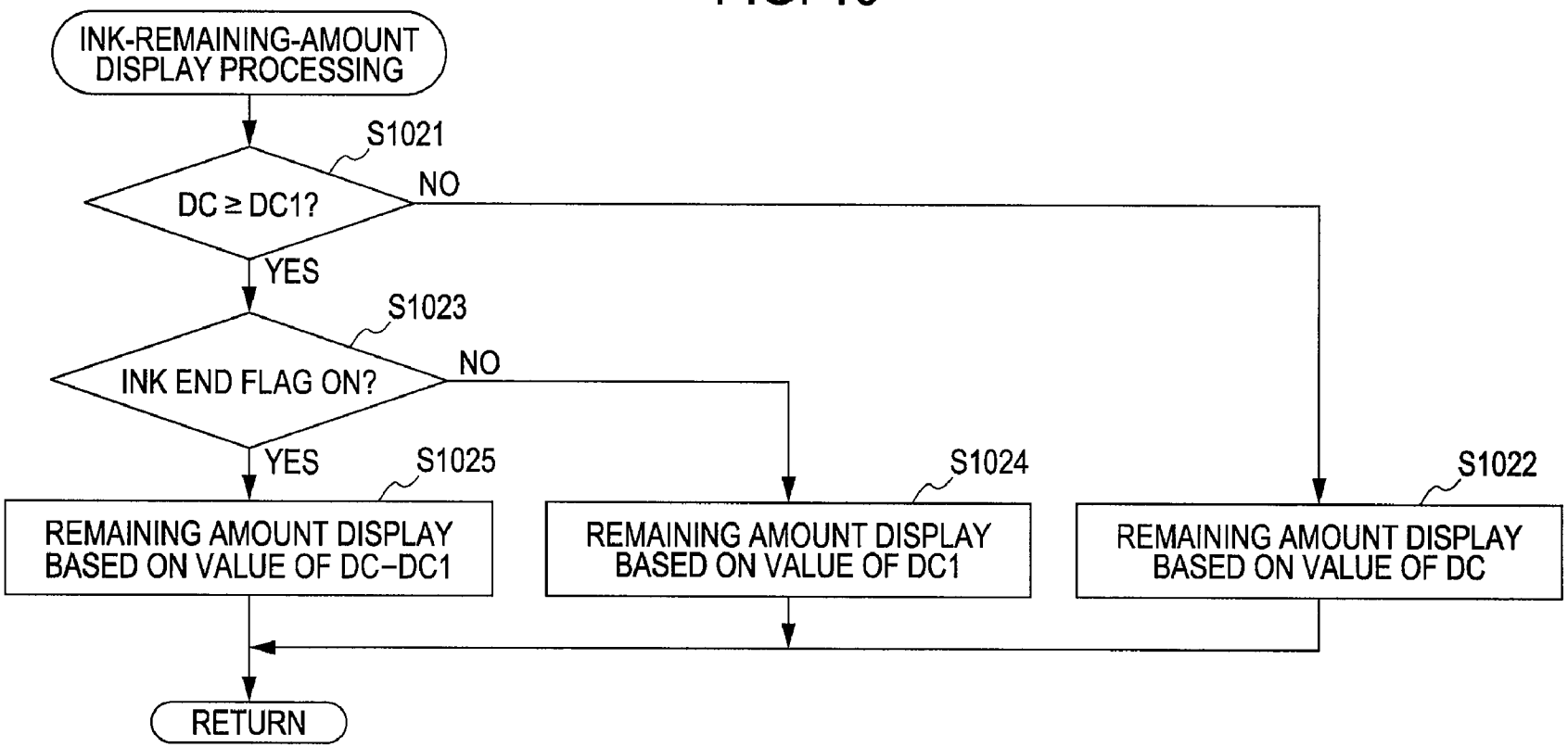
FIG. 10 is a flowchart that shows a processing routine that is performed during ink-remaining-amount display processing executed by a printing apparatus according to an embodiment of the invention.
Figure 11:
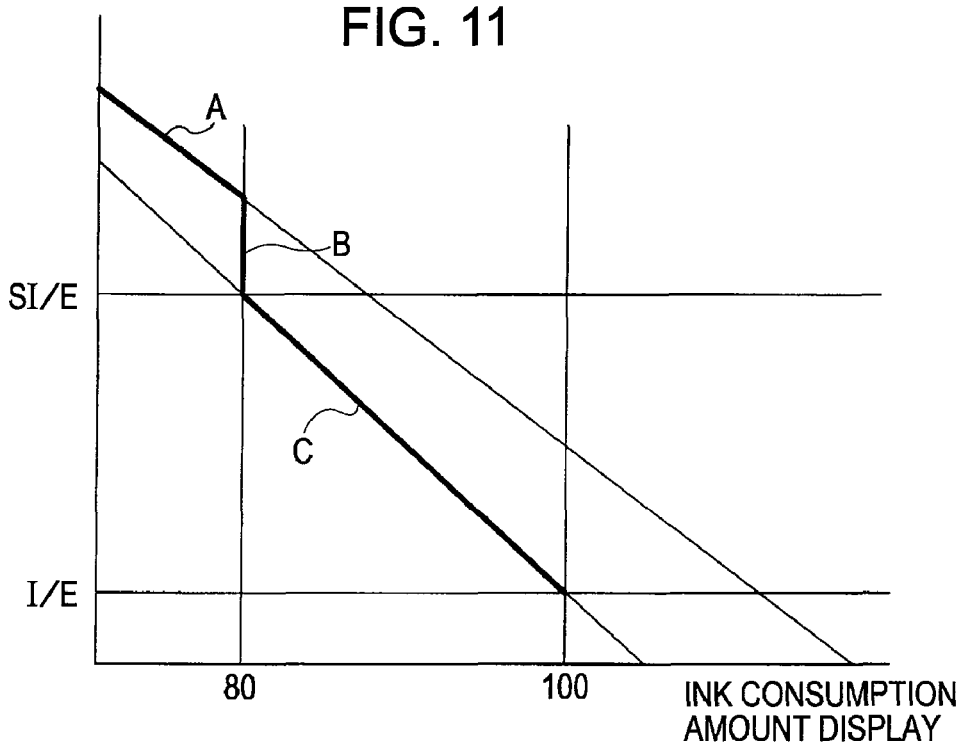
FIG. 11 is an explanatory diagram that illustrates the relationship between the amount of ink and ink-consumption-amount display according to an embodiment of the invention.
Figure 12:
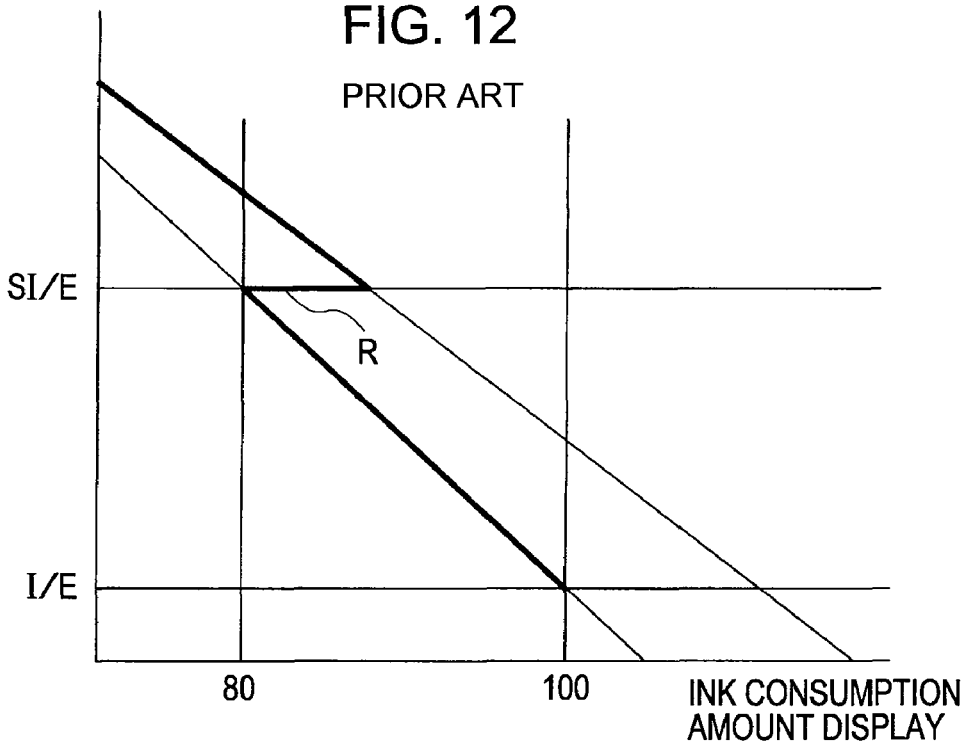
FIG. 12 PRIOR ART
FIG. 12 is an explanatory diagram that illustrates the relationship between the amount of ink and ink-consumption-amount display in a conventional ink amount control processing.
Figure 13:
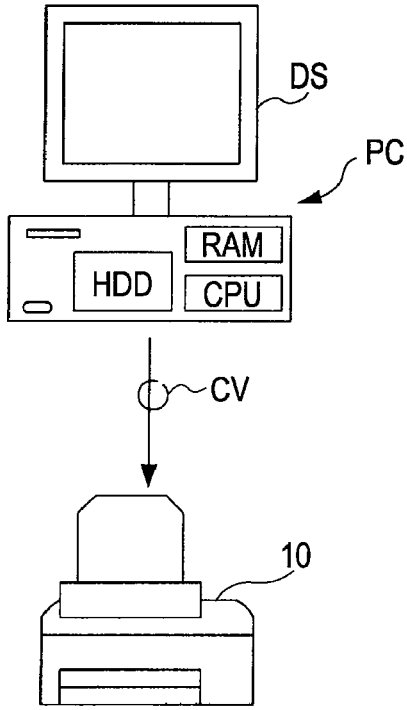
FIG. 13 is an explanatory diagram that schematically illustrates an example of a system configuration in which a personal computer functions as an ink amount control apparatus.

With reference to FIGS. 7-13, the ink amount control processing according to the present embodiment of the invention is explained below. FIG. 7 is a flowchart that shows a processing routine that is performed during the ink amount control processing executed by a printing apparatus according to this embodiment of the invention. FIG. 8 is an explanatory diagram that illustrates the relationship between dot count values and the amount of ink. FIG. 9 is an explanatory diagram that illustrates the relationship between dot count values and the amount of ink in the ink amount control processing according to this embodiment of the invention. FIG. 10 is a flowchart that shows a processing routine that is performed during the ink-remaining-amount display processing executed by a printing apparatus according to this embodiment of the invention. FIG. 11 is an explanatory diagram that illustrates the relationship between the amount of ink and the ink-consumption-amount display according to this embodiment of the invention. FIG. 12 is an explanatory diagram that illustrates the relationship between the amount of ink and the ink-consumption-amount display in a conventional ink amount control processing.

This processing routine is carried out upon reception of a printing request at the printing apparatus 10. When this processing routine is started, the CPU 41 acquires a dot count value DC stored in the memory 42 (step S100). The dot count value DC is stored into the volatile memory area of the memory 42. As has already been described, the memory 60, which stores the dot count value DC as ink-amount-related information, is affixed to each of the ink cartridges CA1-CA4 according to this embodiment of the invention. Accordingly, the start-up acquisition of the initial dot count value DC when the power of the printing apparatus 10 is turned on is conducted by reading the dot count value DC out of the memory 60.

The CPU 41 uses the acquired dot count value DC to perform the ink-remaining-amount display processing (step S102). The details of the ink-remaining-amount display processing are discussed later. The CPU 41 operates in a standby state until a printing request is received (step S104: No). Upon reception of a request for print processing (step S104: Yes), the CPU 41 performs the requested print processing (step S106). Herein, the request for print processing includes several kinds of ink consumption requests, including but not limited to, periodical ink discharge that is conducted for the purpose of maintaining the print heads IH1-IH4 in a good condition (i.e. flushing). The dot count value DC has to be updated also in the case of flushing because the execution of flushing consumes ink contained in the ink cartridges CA1-CA4.

During the print processing, the CPU 41 creates raster data indicating dot formation (ON)/dot non-formation (OFF) in the main-scan direction along which the print heads IH1-IH4 move based on image data subjected to image processing, binarization processing, or multilevel processing.

On the basis of the created raster data, the CPU 41 drives the carriage 11, the platen 13, and the print heads IH1-IH4 so that ink drops land at desired positions on the printing paper P to generate a dot pattern that indicates an image (text). The print processing ends upon completion of a print job, which constitutes a unit of print processing.

Upon completion of the print job, the CPU 41 updates the dot count value DC (step S108). More specifically, the CPU 41 overwrites the previous dot count value stored in the memory 42 to be replaced by the update dot count value DC at the end of the print processing. The CPU 41 may write the updated dot count value into the memory 60 of the ink cartridge CA. The dot count value DC is a parameter that indicates the amount of ink discharged during the print processing, which is expressed in the unit of, for example, ink weight, or ink weight percentage. In an example illustrated in FIG. 8 and FIG. 9, the dot count value is expressed in percentage, where a unit dot count coefficient is predetermined such that the value amounts to 100% at the ink end dot counts. On the basis of the raster data created during the print processing, the CPU 41 counts, for example, the number of dot generations for each ink color so as to calculate the dot count value DC. If the print heads IH1-IH4 are capable of generating dots having more than one type of diameter, for example, a small-diameter dot, a middle-diameter dot, and a large-diameter dot, the number of dot generations is counted for each dot, and each of the counted dot-generation numbers is multiplied by the corresponding unit dot count coefficient, which is defined for each dot diameter, so as to obtain the dot count value DC. When there is more than one type of dot diameter, the unit dot count coefficient associated with the large dot or the middle-size dot is a multiple of the unit dot count coefficient associated with the small dot, obtained by multiplying it by a predetermined factor.

As illustrated in FIG. 8, according to ink-remaining-amount control based on dot counting, a margin of error E could occur in the amount of ink when the dot count value DC equals to 100%. In FIG. 8, the vertical axis represents actual ink amount (weight or volume), whereas the horizontal axis represents the dot count value DC. For example, even in a case where a plurality of ink cartridges CA having the same amount of ink filled to their ink capacity is provided, if there is a positive margin of error between the amount of ink that is predefined for any arbitrary dot diameter and the amount of ink that is actually discharged, and if the arbitrary dot diameter is used frequently, the amount of ink decreases along the line Lmax shown in FIG. 8. On the other hand, if there is a negative margin of error between the amount of ink that is predefined for any arbitrary dot diameter and the amount of ink that is actually discharged, and if the arbitrary dot diameter is used frequently, the amount of ink decreases along the line Lmin shown in FIG. 8.

The CPU 41 performs ink end detection processing (step S110). More specifically, the CPU 41 transmits a request for ink end detection processing to the sensor ink end judgment circuit 43. Upon reception of the ink end detection processing request, as has already been described, the sensor ink end judgment circuit 43 causes the sensor driving circuit 431 to apply one type or two types of driving voltage(s) to the ink end sensor 30 of each of the ink cartridges CA1-CA4. On the basis of the detection-result voltage obtained after application of the driving voltage(s), the sensor ink end judgment circuit 43 judges whether or not there is a predetermined amount, or larger, of ink contained in each of the ink cartridges CA1-CA4, in other words, whether each of the ink cartridges CA1-CA4 has reached a sensor ink end state or not.

A notification as to whether it has reached the sensor ink end or not is transmitted from the sensor ink end judgment circuit 43 to the CPU 41. If the CPU 41 receives a notification to the effect that it has not reached the sensor ink end (step S112: No), it replaces the sensor ink end dot count value DCA by the previously updated dot count value DC (step S114), and returns to the step S102 so as to update the display of the remaining amount of ink. Herein, the sensor ink end dot count value DCA denotes a dot count value that is counted immediately before the judgment (i.e. detection) of the sensor ink end, or in other words, after the last judgment of the presence of a predetermined amount of ink in the ink cartridge CA (P1, DCA1 in FIG. 9); and therefore, there could be some gap between the sensor ink end dot count value DCA1 and the dot count value at the exact moment of the sensor ink end judgment. Note that the sensor ink end dot count value DCA may be obtained after the judgment of the sensor ink end (P2, DCA2 in FIG. 9).

On the other hand, if the CPU 41 receives a notification to the effect that it has reached the sensor ink end (step S112: Yes), it turns an ink end flag ON (step S116). The ink end flag is a flag for recording the sensor ink end when once it is detected. The ink end flag is stored into the nonvolatile memory area of the memory 42, and into the memory 60 of each of the ink cartridges CA1-CA4, too.

The CPU 41 uses the updated dot count value DC and the sensor ink end dot count value DCA to judge a dot ink end, which is an ink end based on dot counts (step S118). More specifically, the CPU 41 judges whether the mathematical condition of "DC−DCA≧DCref" is satisfied or not. In other words, as illustrated in FIG. 9, the CPU 41 judges whether the difference between the dot count value at the time of the sensor ink end judgment, that is, DCA and the current dot count value DC is not less than the judgment value DCref or not.

In FIG. 9, the vertical axis represents actual ink amount (weight or volume), whereas the horizontal axis represents the dot count value DC. On the vertical axis, SI/E denotes the amount of ink at the time of the sensor ink end, while DI/E denotes the amount of ink at the time of the dot count ink end. In this embodiment of the invention, once the sensor ink end is judged/detected, the unit dot count coefficient used for dot counting is increased. That is, the unit dot count coefficient is changed from a small one corresponding to the line Lmin shown in FIG. 9 to a large one corresponding to the line Lmax shown therein. Consequently, according to an example illustrated in FIG. 9, ink is consumed (i.e. counted) along the line Lmin until the sensor ink end is judged/detected. Once after the judgment/detection of the sensor ink end, ink is counted along the line Lmin', which has the same inclination as that of the line Lmax. Alternatively, if ink is consumed along a line having a medium angle of inclination between the inclination of the line Lmin and the inclination of the Lmax, and if the angle of the medium inclination is closer to the inclination of the line Lmin than to the inclination of the line Lmax, the unit dot count coefficient may be decreased. If this is the case, it is possible to improve ink consumption efficiency in the ink cartridge CA.

When the sensor ink end is judged/detected, the amount of ink contained in the ink cartridge CA has become small. With the increase in the unit dot count coefficient, it is possible to reduce or avoid the occurrences of so-called "empty-cartridge printing", that is, the undesirable execution of print processing when the ink cartridge CA is in an empty state. Alternatively, it may be configured such that a judgment value corresponding to a medium inclination between the inclination of the line Lmin and the inclination of the line Lmax is set as the judgment value DCref so as to determine which one of the inclinations, that is, either the inclination of the Lmin or the inclination of the Lmax, is closer to the inclination of a line indicating the consumption of ink in the printing apparatus 10 on the basis of the ink consumption state up to the judgment/detection of the C sensor ink end; and in such a configuration, the judgment value DCref is increased if the inclination of the line indicating the consumption of ink in the printing apparatus 10 is closer to the inclination of the line Lmin, whereas the DCref is decreased if the consumption line is closer to the inclination of the line Lmax. To be more concrete, the judgment value DCref may be changed depending on which one of the dot count values DCA at the time of the sensor ink end of the line Lmin or the Lmax is closer to the dot count value DCA at the time of judgment/detection of the sensor ink end. In this case, it is possible to efficiently consume ink contained in the ink cartridge CA on the basis of the degree/inclination of ink consumption in the printing apparatus 10.

If the CPU 41 judges that the mathematical condition of "DC−DCA≧DCref" is satisfied (step S118: Yes), it directs the display panel 191 to display ink end (step S120) to terminate this processing routine.

If the CPU 41 judges that the mathematical condition of "DC−DCA≧DCref" is not satisfied (step S118: No), the process returns to the step S102 so that the ink-remaining-amount display processing is performed.

With reference to FIGS. 10-12, the ink-remaining-amount display processing executed in the step S102 is explained below. FIG. 10 is a flowchart that shows a processing routine that is performed during the ink-remaining-amount display processing executed by a printing apparatus according to this embodiment of the invention. FIG. 11 is an explanatory diagram that illustrates the relationship between the ink-remaining-amount display and the actual amount of ink according to this embodiment of the invention. FIG. 12 is an explanatory diagram that illustrates the relationship between the ink-remaining-amount display and the actual amount of ink according to prior art.

The CPU 41 judges whether the dot count value DC is not less than an ink low judgment value DC1 or not (step S1021). The ink low judgment value DC1 is a judgment value that corresponds to a dot count value smaller than the dot count value DC at which the sensor ink end is judged/detected (refer to FIG. 9). Because the ink low judgment is made before judgment/detection of the sensor ink end, as described later in detail, it is possible to reduce or avoid the occurrences of any backset display of the remaining amount of ink (increase) and/or redisplay (the appearance of the same dot count value more than one times) which is attributable to a gap from the dot count value DC at the time of the sensor ink end.

If the CPU 41 judges that the mathematical condition of "DC≧DC1" is not satisfied (step S1021: No), it executes the display of the remaining amount of ink on the display panel 191 based on the dot count value DC (step S1022); and thereafter, the process returns to the main routine illustrated in FIG. 7. In this case, the display of the remaining amount of ink changes along the line A illustrated in FIG. 11.

If the CPU 41 judges that the mathematical condition of "DC≧DC1" is met (step S1021: Yes), it judges whether the ink end flag is turned ON or not (step S1023). More specifically, the CPU 41 accesses the flag storage address of the memory 42 so as to judge whether the ink end flag is turned ON, for example, if the flag 1 is stored therein or not. Judging that the ink end flag is not set ON (step S1023: No), the CPU 41 uses the dot count value corresponding to the ink low judgment value DC1 to execute the display of the remaining amount of ink on the display panel 191 (step S1024); and thereafter, the process returns to the main routine illustrated in FIG. 7. Therefore, as long as the step S1024 is performed, the remaining amount of ink displayed on the display panel 191 is kept constant along the line B illustrated in FIG. 11.

Judging that the ink end flag is set ON (step S1023: Yes), the CPU 41 executes the display of the remaining amount of ink on the display panel 191 based on the difference between the counted dot count value DC and the ink low judgment value DC1 (step S1025); and thereafter, the process returns to the main routine illustrated in FIG. 7. In this case, the display of the remaining amount of ink changes along the line C illustrated in FIG. 11.

As explained above, according to the printing apparatus 10 of the present embodiment of the invention, because the dot ink end judgment is made by comparing the difference between the dot count value DCA at the time of the sensor ink end judgment/detection and the current dot count value DC with the judgment value DCref, it is possible to achieve a precise judgment of dot ink end even if the initial amount of ink contained in the ink cartridges CA vary from one cartridge to another and/or regardless of any variation in the amount of ink discharged from the print head IH, and any variation in dot count values due to differences in manner of use.

In addition, because the unit dot count coefficient is increased after the judgment/detection of the sensor ink end, it is possible to reduce or avoid the occurrences of ink shortage, thereby reducing the possibility of, or avoiding, any damage to the print head IH due to empty-cartridge printing.

Moreover, according to the printing apparatus 10 of this embodiment of the invention, dot counting is performed until the sensor ink end judgment/detection, and the remaining amount of ink is displayed based on the dot count value; and therefore, it is possible to perform the display of the remaining amount of ink which represents ink consumption with a good precision both before and after detection of the sensor ink end. Furthermore, because it is possible to store the dot count value into the memory 60 of the ink cartridge CA one after another, it is possible to continue the control/management of the remaining amount of ink even when the ink cartridge CA is detached before the detection of the sensor ink end.

As the problems of the ink-remaining-amount display processing according to prior art, the backset display of the remaining amount of ink (increase) R and/or the second occurrence of the same dot count value could occur as illustrated in FIG. 12 because the correction of the dot count value is triggered by the detection of the ink end by the ink end sensor. When such a defective display occurs, it is unclear which one of these conflicting values is reliable, thereby making it impossible to utilize the dot count value.

In contrast, according to this embodiment of the invention, it is possible to solve the above problems of the prior art by using the ink low judgment value DC1, which is a judgment value corresponding to a dot count value smaller than the dot count value DC at which the sensor ink end is judged/detected.

In addition, according to the printing apparatus 10 of this embodiment of the invention, it is possible to control the amount of ink even in a case where an increment-type memory, which stores only increases in counting, is employed as the memory 60 of the ink cartridge CA because there could not occur any backset (decrease) in the dot count value DC.

Moreover, according to the above embodiment of the invention, it is possible to write the dot count value DC having the value of 100 or greater into the memory 60 of the ink cartridge CA because the dot count value DC is increased sequentially. Therefore, on the basis of the dot count value DC memorized in the memory 60, it is possible to verify any variation in the initial amount of ink contained in the ink cartridge CA, and/or variation in the amount of ink discharge of a printing apparatus.

Other Exemplary Embodiments (1) Although the above embodiment of the invention is explained while taking the printing apparatus 10 as an example, the ink amount control executed in the printing apparatus 10 may alternatively be executed by a personal computer PC that is connected to the printing apparatus 10 via a connection cable CV. In such an alternative configuration, the ink-remaining-amount control processing is performed by a printer driver that is stored in the hard disk drive (HDD) so that the remaining amount of ink is displayed as a part of display offered by the printer driver on the screen of a display apparatus DS that is connected to the personal computer PC. As still another configuration, the ink-remaining-amount control processing according to the embodiment of the invention may be implemented as a printer driver, or a computer-readable storage medium in which the printer driver is stored, such as a CD-ROM, a DVD-ROM, and so on.

(2) Although the ink end sensor 30 is provided in the ink cartridge CA according to the above embodiment of the invention, it may alternatively be provided in the printing apparatus 10. For example, it may alternatively be configured that the ink cartridge is provided with a detection window, which allows the liquid surface/level to be detected optically, and that an optical sensor provided in the printing apparatus 10 judges whether the ink liquid level is not lower than a predetermined level or not. In such a configuration, it is possible to judge whether or not the ink liquid level is not lower than a predetermined level on the basis of a difference between the volume of transmitted light when some ink is present in the detection window and the volume of transmitted light when no ink is present in the detection window, or on the basis of a difference of the volume of reflected light therebetween.

(3) According to the above embodiment of the invention, the sensor ink end judgment processing is conducted by means of a piezoelectric-effect element that is used as the sensor 30, where a driving voltage is applied (charged) from the control circuit 40 to the sensor 30, followed by discharging thereof so as to obtain a response voltage (vibration frequency). Notwithstanding the above configuration, any sensor suffices as long as it is capable of sending back, to the control circuit 40, any response signal/response voltage in reply to the inputted detection signal/driving voltage regardless of whether there is much ink remaining or not.

(4) According to the above embodiment of the invention, although the sensor ink end judgment circuit 43 is provided in the printing apparatus 10, the sensor ink end judgment circuit 43 may be provided in the ink cartridge CA.

(5) According to the above embodiment, the invention is implemented in the form of the ink cartridge CA and the printing apparatus 10 to which the ink cartridge CA is attached. However, the invention is not limited to such a specific embodiment but also applicable to other various kinds of apparatuses that consume liquids, for example, a liquid atomization apparatus that sprays/ejects paint/laminated material contained in a cartridge(s). Even in such a variant embodiment where a liquid(s) is consumed, the invention still provides its advantage, that is, the enhanced control of the amount of liquid consumption.

Figure 14:
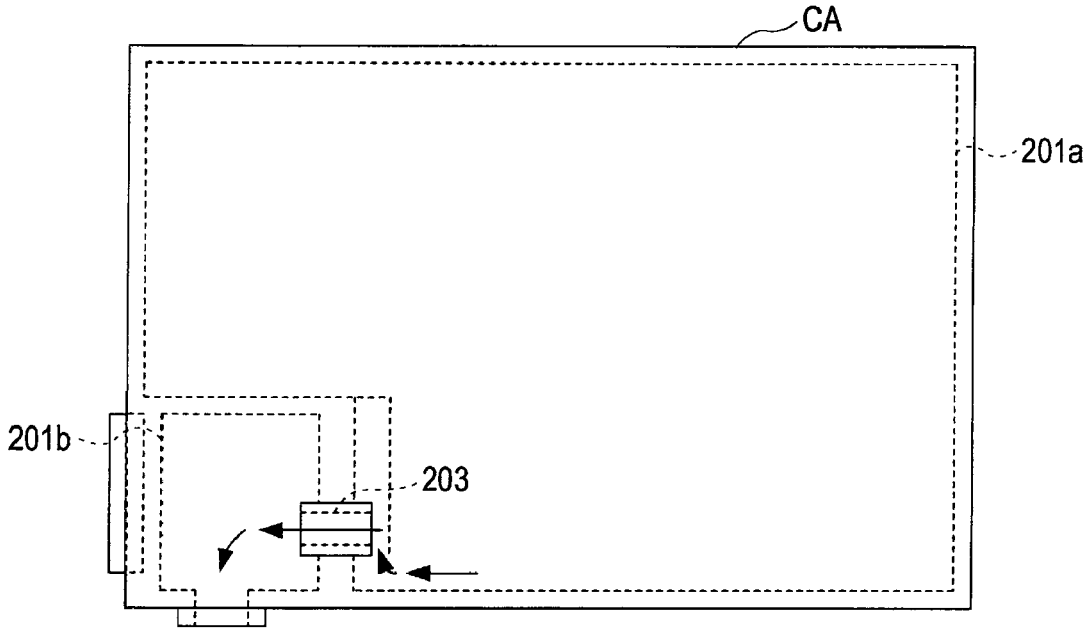
FIG. 14 is an explanatory diagram that schematically illustrates another example of the configuration of an ink cartridge.

(6) As an alternative configuration, the ink cartridge CA may be structured as illustrated in FIG. 14. FIG. 14 is an explanatory diagram that schematically illustrates another example of the configuration of the ink cartridge CA. According to the above embodiment of the invention, although the number of the ink-containing portion of the ink cartridge CA is just one, the ink-containing portion may alternatively be configured to have two sections therein, that is, the main ink-containing portion 201*a* and the sub ink-containing portion 201*b*. With such an alternative configuration, it is possible to easily set the residual printing-capacity amount, that is, the printable amount after the detection of the ink end by the ink end sensor 30, by merely adjusting the capacity of the sub ink-containing portion 201*b*. In addition, since there is a predetermined amount of ink still remaining in the sub ink-containing portion 201*b* even after the judgment/detection of the ink end, it is possible to prevent the occurrence of empty-cartridge printing.

In the same manner as the above embodiment of the invention, the ink end sensor 30 is provided in the communication path 203 that communicates the main ink-containing portion 201*a* with the sub ink-containing portion 201*b*. The communication path 203 is structured as a narrow passage that is capable of causing capillary action, thereby reducing or avoiding the infiltration of any air bubble that has inadvertently entered into the ink-containing portion 201 into the communication path 203. With such a configuration, it is possible to reduce or avoid any erroneous detection of the ink end by the ink end sensor 30 due to any air bubble that could be present in the proximity of the ink end sensor 30 even though there is still ample amount of ink remaining in the main ink-containing portion 201*a*. On the other hand, since a large amount of air bubbles enter into the communication path 203 when ink runs out of the main ink-containing portion 201*a*, the ink end sensor 30 detects the ink end as it is supposed to do so.

(7) According to the above embodiment of the invention, although the unit dot count value is increased or decreased at a medium inclination between the inclination of the line Lmin and the inclination of the line Lmax, an inclination that is greater than the inclination of the line Lmax (a greater unit dot count value) may be used instead thereof. With such a configuration, it is possible to reduce or avoid the occurrences of ink shortage when ink is consumed along the line Lmax.

As described above, although the present invention is explained while discussing the exemplary embodiments of the invention as well as variations thereof, the specific embodiments described above are provided solely for the purpose of facilitating the understanding of the invention. It should be noted that, in no case, these explanatory embodiments are interpreted to limit the scope of the invention. Without departing from the spirit of the invention as well as the scope of the appended claims, the invention may be changed, altered, modified, adapted, or improved by a person skilled in the art. It is the intention of the inventor/applicant that the scope of the invention covers any equivalents without departing therefrom.

What is claimed is:

1. A liquid consumption apparatus to which a liquid container for containing liquid is able to be attached, the liquid consumption apparatus comprising:

a liquid consumption section that consumes the liquid contained in the liquid container;

a counting section that counts the amount of the liquid consumed by the liquid consumption section as a liquid consumption amount;

a liquid amount memory section that memorizes the liquid consumption amount counted by the counting section;

a reception section that receives a detection signal indicating that the amount of the liquid contained in the liquid container is not more than a predetermined amount;

a detection-time liquid amount memory section that memorizes the liquid consumption amount at the time of reception of the detection signal as a detection-time liquid consumption amount, that is, a liquid consumption amount at the time of detection; and a judgment section that judges that the liquid container is empty by calculating that the amount of difference between the liquid consumption amount memorized in the liquid amount memory section and the detection-time liquid consumption amount is more than a specified amount.

2. The liquid consumption apparatus according to claim 1, wherein the counting section counts the amount of the liquid consumed by the liquid consumption section by counting unit liquid consumption amount, and increases the unit liquid consumption amount upon the reception of the detection signal by the reception section.

3. The liquid consumption apparatus according to claim 1, wherein the counting section counts the amount of the liquid consumed by the liquid consumption section by counting unit liquid consumption amount, and decreases the unit liquid consumption amount upon the reception of the detection signal by the reception section.

4. The liquid consumption apparatus according to claim 1, wherein the judgment section increases or decreases the specified amount depending on the degree of consumption with respect to the liquid consumption amount up to the reception of the detection signal by the reception section.

5. The liquid consumption apparatus according to claim 1, in which the liquid container is provided with a detector for detecting whether the amount of the liquid contained in the liquid container is not more than a predetermined amount or not, the liquid consumption apparatus further comprising: a detector driving section that drives the detector to obtain a detection result, wherein the reception section receives the detection signal from the detector, which is driven by the detector driving section.

6. The liquid consumption apparatus according to claim 1, further comprising: a detector for detecting whether the amount of the liquid contained in the liquid container is not more than a predetermined amount or not, wherein the reception section receives the detection signal from the detector.

7. The liquid consumption apparatus according to claim 1, wherein the detection-time liquid amount memory section memorizes the liquid consumption amount memorized in the liquid amount memory section at the time of reception of the detection signal as the detection-time liquid consumption amount.

8. The liquid consumption apparatus according to claim 1, wherein the detection-time liquid amount memory section memorizes the liquid consumption amount counted by the counting section after reception of the detection signal as the detection-time liquid consumption amount.

9. The liquid consumption apparatus according to claim 1, in which the liquid container is provided with a memory device, the liquid consumption apparatus further comprising: a writing section that writes the liquid consumption amount memorized in the liquid amount memory section into the memory device provided in the liquid container at a predetermined timing, wherein the counting section reads the liquid consumption amount memorized in the memory device at least at the time of activation of the liquid consumption apparatus so as to count the liquid consumption amount by using the read-out liquid consumption amount.

10. The liquid consumption apparatus according to claim 1, further comprising: a display section that displays information on the amount of the liquid based on the liquid consumption amount until the liquid consumption amount reaches a reference liquid consumption amount, based on the reference liquid consumption amount after the liquid consumption amount has reached the reference liquid consumption amount but until the detection signal is received, and based on the liquid consumption amount and the detection-time liquid consumption amount after the detection signal has been received.

11. The liquid consumption apparatus according to claim 1, wherein the liquid consumption apparatus is an ink jet printer, and the liquid container is an ink container that contains ink.

12. A liquid consumption amount control apparatus that controls liquid consumption amount in a liquid consumption apparatus to which a liquid container for containing liquid is attached for use, the liquid consumption amount control apparatus comprising:

a liquid consumption amount information reception section that receives liquid consumption amount information on the amount of the liquid consumed by the liquid consumption apparatus from the liquid consumption apparatus;

a liquid amount memory section that memorizes the received liquid consumption amount information one after another;

a detection signal reception section that receives a detection signal indicating that the amount of the liquid contained in the liquid container is not more than a predetermined amount;

a detection-time liquid amount memory section that memorizes the liquid consumption amount at the time of reception of the detection signal as a detection-time liquid consumption amount, that is, a liquid consumption amount at the time of detection; and a judgment section that judges that the liquid container is empty by calculating that the amount of difference between the liquid consumption amount memorized in the liquid amount memory section and the detection-time liquid consumption amount is not more than a specified amount.

13. The liquid consumption amount control apparatus according to claim 12 that is connected to a display apparatus, the liquid consumption amount control apparatus further comprising:

a display control section that controls the display apparatus to display information on the amount of the liquid based on the liquid consumption amount until the liquid consumption amount reaches a reference liquid consumption amount, based on the reference liquid consumption amount after the liquid consumption amount has reached the reference liquid consumption amount but until the detection signal is received, and based on the liquid consumption amount and the detection-time liquid consumption amount after the detection signal has been received.

14. A liquid consumption amount control method for controlling liquid consumption amount in a liquid consumption apparatus to which a liquid container is attached for use, the liquid consumption amount control method comprising:

counting the amount of the liquid consumed by a liquid consumption section that consumes the liquid contained in the liquid container as a liquid consumption amount;

memorizing the liquid consumption amount counted by a counting section into a memory apparatus one after another;

receiving a detection signal which indicates that the amount of the liquid contained in the liquid container is not more than a predetermined amount;

memorizing the counted liquid consumption amount as a detection-time liquid consumption amount, that is, a liquid consumption amount at the time of detection, into the memory apparatus; and judging that the liquid container is empty by calculating that the amount of difference between the memorized liquid consumption amount and the detection-time liquid consumption amount is not more than a specified amount.

15. The liquid consumption amount control method according to claim 14, further comprising:

displaying information on the amount of the liquid based on the liquid consumption amount until the liquid consumption amount reaches a reference liquid consumption amount, based on the reference liquid consumption amount after the liquid consumption amount has reached the reference liquid consumption amount but until the detection signal is received, and based on the liquid consumption amount and the detection-time liquid consumption amount after the detection signal has been received.

* * * * *